United States Patent [19]

Tanabe

[11] Patent Number: 4,488,025

[45] Date of Patent: Dec. 11, 1984

[54] COMBINED HIGH-FREQUENCY AND THERMAL HEATING OVEN

[75] Inventor: Takeshi Tanabe, Higashiosaka, Japan

[73] Assignee: Sharp Kabushiki Kaisha, Osaka, Japan

[21] Appl. No.: 402,422

[22] Filed: Jul. 28, 1982

[30] Foreign Application Priority Data

| | | | |
|---|---|---|---|
| Jul. 28, 1981 | [JP] | Japan | 56-118994 |
| Oct. 30, 1981 | [JP] | Japan | 56-162884[U] |
| Dec. 1, 1981 | [JP] | Japan | 56-193973 |
| Dec. 17, 1981 | [JP] | Japan | 56-204679 |

[51] Int. Cl.[3] ..... H05B 9/06

[52] U.S. Cl. ..... 219/10.55 B; 99/325

[58] Field of Search ..... 219/10.55 B, 10.55 R, 219/10.55 E; 99/325

[56] References Cited

U.S. PATENT DOCUMENTS

| | | | |
|---|---|---|---|
| 3,569,656 | 3/1971 | White et al. | 219/10.55 P |
| 4,097,707 | 6/1978 | Kobayashi et al. | 219/10.55 B |
| 4,162,381 | 7/1979 | Buck | 219/10.55 B |
| 4,317,977 | 3/1982 | Buck | 219/10.55 P |
| 4,350,860 | 9/1982 | Ueda | 219/10.55 B |
| 4,357,513 | 11/1982 | Kawata et al. | 219/10.55 B |
| 4,376,131 | 3/1983 | Mori et al. | 426/231 |
| 4,379,964 | 4/1983 | Kanazawa et al. | 219/492 |
| 4,383,158 | 5/1983 | Niwa | 219/10.55 B |

FOREIGN PATENT DOCUMENTS

| | | | |
|---|---|---|---|
| 55-49626 | 4/1980 | Japan | 219/10.55 B |

*Primary Examiner*—C. L. Albritton
*Assistant Examiner*—M. M. Lateef
*Attorney, Agent, or Firm*—Birch, Stewart, Kolasch & Birch

[57] ABSTRACT

An oven comprises a chamber, a support for a foodstuff within the chamber, a high frequency electromagnetic wave heating device, a second heating device within the chamber for heating food by application of thermal energy, the second heating device being movably supported whereby it is translatable toward and away from the foodstuff, and a sensor for detecting a condition of the foodstuff during heating. The oven is responsive to the sensor for identifying the foodstuff, for controlling the position of the second heater within the chamber, and for controlling the periods of time during which the second heater is operative.

12 Claims, 10 Drawing Figures

COMBINED HIGH-FREQUENCY AND THERMAL HEATING OVEN

BACKGROUND OF THE INVENTION

This invention relates to an oven range that automatically controls its high temperature heater according to the kind of the foodstuff being cooked, and more particularly, this invention includes means to automatically control the height position of the heater in the oven.

Conventionally, in order to improve the operational characteristics of an oven, it is designed to be automatically responsive to a gas sensor so that an optimum heating can be performed according to the menu selected.

When using an oven as referred to above with high frequency heating in order to effectively use the internal space of the oven, it is necessary that the grill or high temperature heater be moved to the highest position, while the grill heater should be lowered to a position about 3 cm higher than the surface of the foodstuff when it is used for cooking.

In order to satisfy such needs, generally, ovens are designed so that the grill heater can be raised and lowered by a position adjustment knob on the external operation panel of the oven.

However, since such an oven is mainly used for high frequency heating and the grill heating operation is rarely performed, users are prone to forget to lower the grill heater to a proper height before starting a grill heating. Even though users may remember to adjust the heater, they may not identify the optimum relationship between the grill heater and foodstuff in the chamber, thus the grill heater may be set at an incorrect height during grill heating operation.

SUMMARY OF THE INVENTION

In an oven range that automatically selects any menu during a grill heating with a gas sensor, this invention represents an improvement in that it includes means for lowering the height of the grill heater to an optimum position in responding to the menu selected.

To achieve this object in an oven comprising functions such as both high frequency heating and grill heating, this invention provides an oven range that includes menu identification means identifying the cooking menu and heater drive means capable of lowering the position of the grill heater in response to the cooking menu that is identified by said menu identification means.

DETAILED DESCRIPTION OF THE INVENTION

In reference to the drawings exemplary embodiments of this invention are described below.

The following describes the automatic control of the grill heating operation when any typical menu such as, for example, "salted mackerel" or "gratin" is being prepared for cooking with the oven of this invention.

Figure 1:
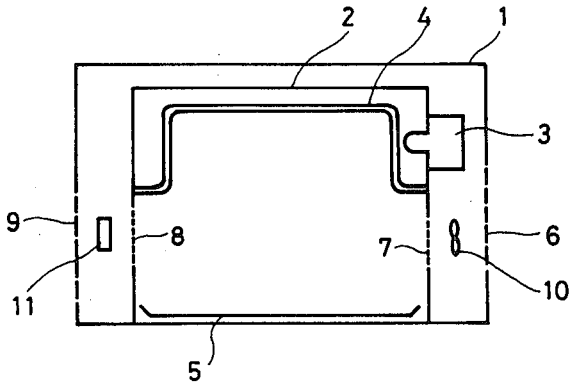
FIG. 1 shows a schematic block diagram of an oven in accordance with this invention.
Figure 2:
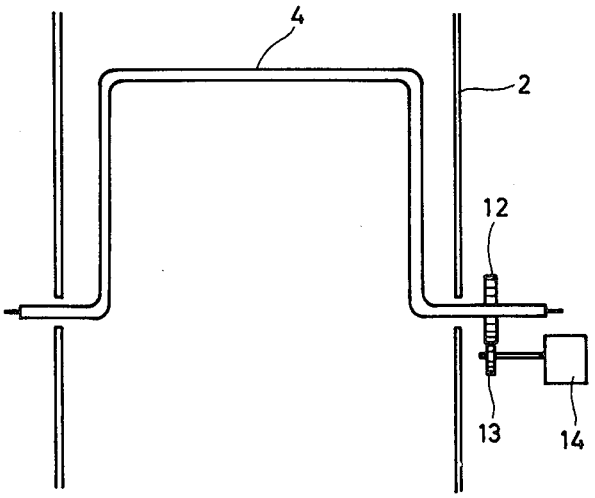
FIG. 2 shows an enlarged view of the essential parts of the range oven range.

FIG. 1 shows a schematic sectional view of the oven. FIG. 2 shows an enlarged view of the essential components of the oven comprising the external housing unit (1), an internal oven (2), a magnetron (3) which is provided at a specific position of the internal oven (2), a heater (4), a turn-table (5), air-inlets (6) and (7) provided in the external housing unit (1) and internal oven (2), fan (10) provided between said air-inlets (6) and (7), and the gas sensor (11) provided between the exhaust outlets (8) and (9).

The heater (4) has a specially bent portion in the center, while both ends extend into the walls of the internal oven (2) so that both ends can be rotated within supports.

A gear (12) is secured to the end extended from the internal oven (2), while said gear (12) is meshed with gear (13) which is secured to the outer shaft of the bi-directional motor (14) installed at a specific position on either the external housing unit (1) or internal oven (2).

Figure 3:
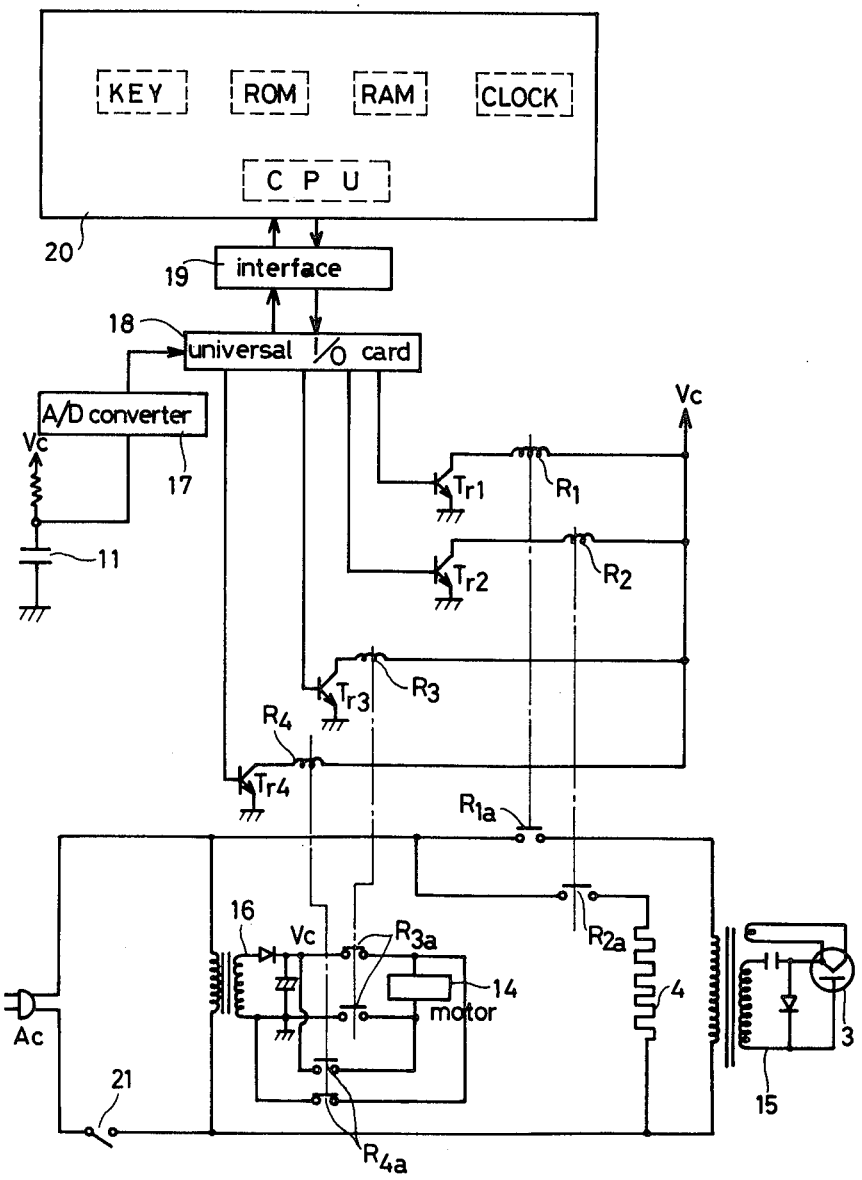
FIG. 3 shows a schematic block diagram of the electric circuitry of the range oven range.

FIG. 3 shows the electric circuitry of an oven in accordance with the invention, comprising an AC current relay contact (R2a) and the grill heater (4) connected in series to each other, and another relay contact (R1a) connected in series to the drive unit (15) that drives the magnetron (3). This circuit is also connected to the DC power circuit (16) that selectively rotates said bi-directional motor (14) either clockwise or counterclockwise through two pairs of relay contacts (R3a) and (R4a).

The output signal from the gas sensor (11) is sent to the micro-computer (20) which comprises the key board key, ROM, RAM, generator clock and the CPU, through the A/D converter (17), universal I/O card (18), and the interface unit (19). Micro-computer (20) provides a signal to switching transistors (TR1), (TR2), (TR3) and (TR4) through said interface unit (19) and universal I/O card (18). Relay coil (R1) that drives the magnetron (3), relay coil (R2) that drives the heater (4), relay coil (R3) that rotates the bi-directional motor (14) clockwise, and the other relay coil (R4) that drives the bi-directional motor (14) counterclockwise, are respectively connected in series to said switching transistors (TR1), (TR2), (TR3) and (TR4).

Symbol (21) represents the door switch associated with the door (not shown) of the oven, and closing it. Note that this door is not illustrated. The door switch allows the AC current to flow through the heater (4), drive circuit (15), and the DC power circuit (16) when the door is closed.

The oven in accordance with this invention performs the following operations.

When cooking, for example, either "salted mackerel" or "gratin" with the grill oven, a high frequency heating is first performed in order to enable the heat to evenly penetrate into every part of either the "salted mackerel" or "gratin" in the heating chamber.

The ensuing grill heating then provides some browning on the surface of the well-heated foodstuff.

When performing the grill heating, different times are needed for cooking different foods such as "salted mackerel" and "gratin" placed in the chamber, generally, about 8 minutes for the former and about 12 minutes for the latter.

Figure 4:
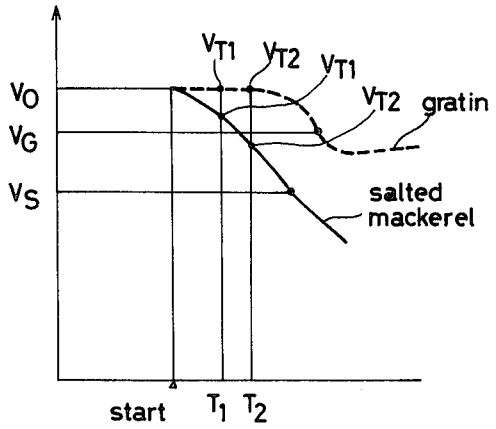
FIG. 4 shows the timewise variation of the output signal from the gas sensor of the range oven range.

In particular, when performing a high frequency heating to cook a mackerel, a variety of gaseous fumes such as, for example, triethylamine are usually generated upon heating, thus causing the output signal level from the gas sensor to drop even at low temperatures. When cooking gratin by a high frequency heating, such gaseous fume are rarely generated at low temperatures. Nevertheless, as soon as the gratin has been heated to the boil point or about 100° C., truene and/or methylisobutylketone are usually generated together with vapour, thus causing the output signal level from the gas sensor to eventually drop, as shown in FIG. 4.

The grill oven embodied by this invention thus identifies that the foodstuff or menu comprises either "salted mackerel" or "gratin" so that the electronic circuits can automatically control the time needed for performing grill heating.

Figure 5:
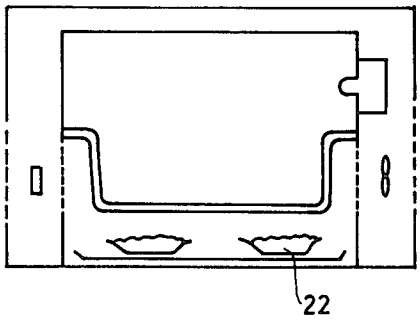
FIG. 5 shows a schematic sectional view of gratin being cooked by means of the grill heating.
Figure 6:
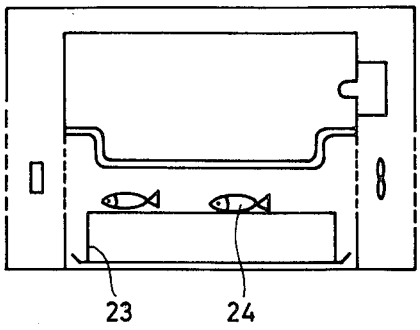
FIG. 6 shows a schematic sectional view of mackerel being cooked by means of the grill heating.

When the menu comprises gratin, the gratin dish (22) is directly placed on the turn-table (5) during heating. When the menu comprises "salted mackerel", the fish is placed directly on metal net (23). Thus, when heating "salted mackerel" on the net, in seeking an optimum height, the heater (4) must be set at a higher position than in cooking gratin on the dish, as shown in FIGS. 5 and 6.

Figure 7:
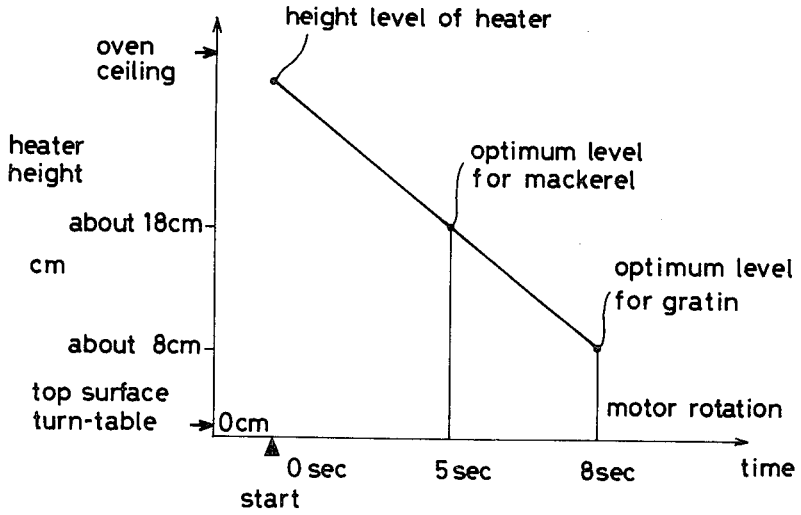
FIG. 7 shows the relationship between the height position of the heater and motor driving time.
Figure 8:
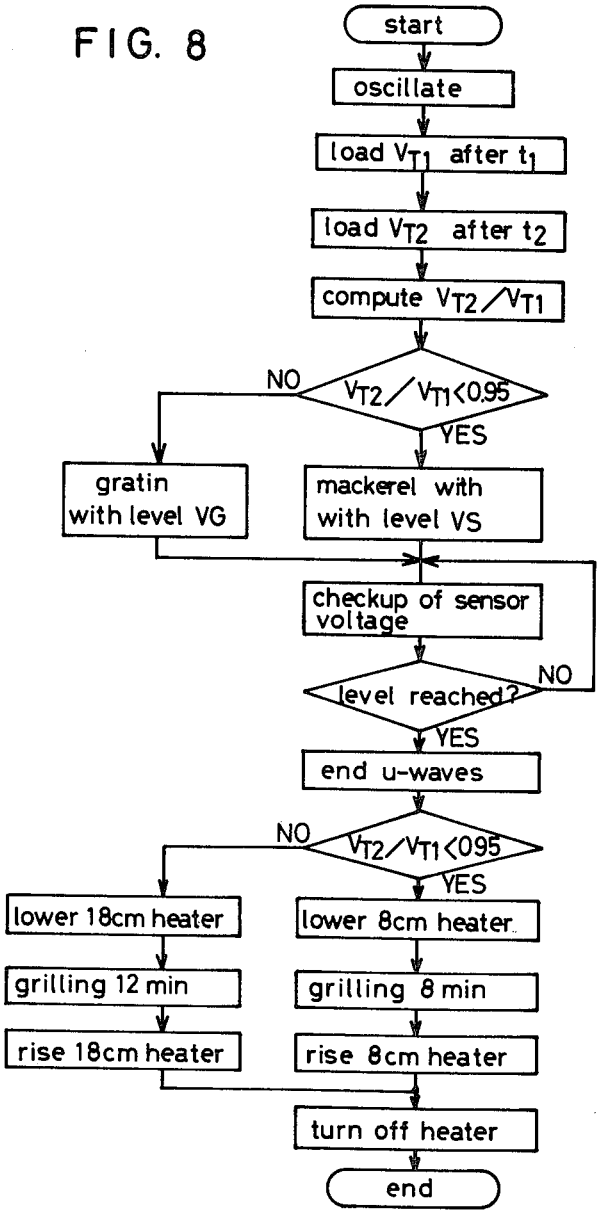
FIG. 8 shows a flow chart representing the operation of the range oven range.

With regard to the height position of the heater (4) while heating a "salted mackerel", taking into consideration the height of the metal net (23), the thickness of "salted mackerel" (24) and the available space between the upper surface of the mackerel (24) and heater (4), the optimum height position of the heater (4) should be about 18 cm in a typical oven. When cooking gratin, also taking into consideration the height of gratin dish (22) and the available space between the upper surface of gratin snd heater (4), the height position of the heater should be about 8 cm. The heater (4) can be positioned at the optimum level by accurately controlling the time of rotation of the bi-directional motor (14) clockwise according to the selected menu, i.e., about 5 seconds needed for cooking "salted mackerel" and about 8 seconds for cooking gratin (FIG. 7).

To use the oven, one must open the door (not illustrated) of the grill oven and place either the "gratin" directly on the turn-table (5) inside the internal oven (2) or "salted mackerel" (24) on the turn-table (5) on the attached metal net (23), then close the door. A grill-activating key (not illustrated) is operated so that relay contact (R1*a*) is closed and the high frequency heating is activated by turning the magnetron (3) ON.

At times (T1) (T2) after the high frequency heating has been activated, the micro-computer (20) monitors the output voltages (VT1) and VT2) from the gas sensor (11), and determines the output voltage ratio VT2/VT1 and identifies if said ratio VT2/VT1 is below 0.95.

If the ratio VT2/VT1 exceeds 0.95, the micro-computer (20) identifies that the menu is "gratin" and designates certain data VG stored in the ROM as the level to activate the grill heating, whereas if the ratio VT2/VT1 is below 0.95, the micro-computer (20) then identifies that the menu is "salted mackerel" and designates data VS stored in the ROM as the level in activating the grill heating.

After these operations are completed, the clock pulse generator of the micro-computer (20) then identifies at every cycle of the clock pulse output whether or not the output level of the signal from the gas sensor (11) is at the preset level VG or VS. As soon as the output signal level from the gas sensor (11) has reached said proper level, switching transistor (TR1) then turns OFF, thus shutting the current flow through relay coil (R1) and opening relay contact (R1*a*). As a result, the magnetron (3) is inactivated so that the high frequency heating will cease. After that, the output signal form the gas sensor (11) cannot be used in controlling the grill heating operation at all.

After these operations are completed, the micro-computer (20) again determines whether said ratio VT2/VT1 is below 0.95 or not. If it exceeds 0.95, relay coil (R3) turns ON for about 8 seconds so that the bi-directional motor (14) will rotate clockwise for about 8 seconds, causing the heater (4) to lower to a position about 3 cm above the upper surface of gratin. Relay coil (R2) is activated in order to allow the current to flow through the heater (4) for about 12 minutes so that gratin can eventually be cooked by the grill heating.

If the output voltage ratio VT2/VT1 is below 0.95, the current flows through relay coil (R3) for about 5 seconds so that the bi-directional motor (14) will rotate clockwise for about 5 seconds, thus causing the heater (4) to lower to a position about 3 cm above the upper surface of mackerel. Relay coil (R2) is activated in order to allow the current to flow through the heater (4) for about 8 minutes so that the salted mackerel can be fully grill-heated.

After these operations are completed, the current is fed to relay coil (R4) so that the bi-directional motor (14) can be rotated counterclockwise to lift the heater (4) up within the internal oven (2), then the current flowing through the heater-driving relay coil (R2) is shut off, turning the heater (4) OFF completing the heating operation.

Figure 9:
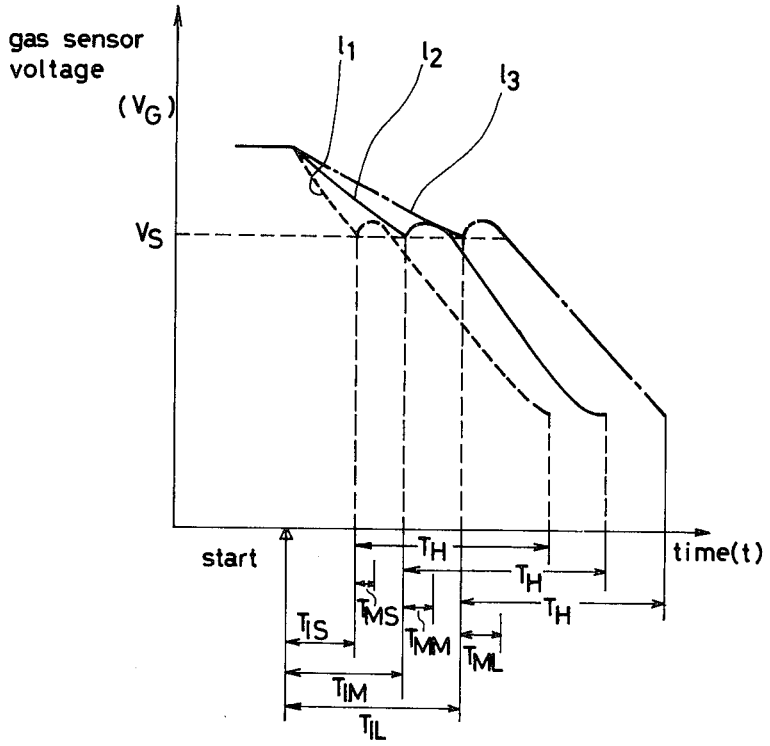
FIG. 9 shows the output characteristics of the gas sensor in another example of this invention.
Figure 10:
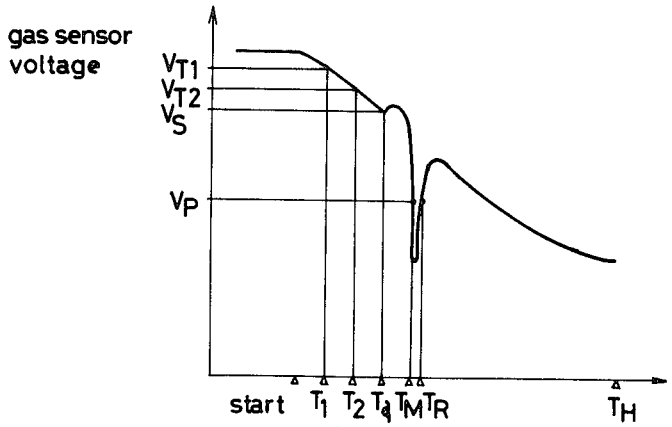
FIG. 10 shows the operational characteristics of another example of the electronic oven range of this invention.

FIG. 9 shows the output characteristics of the gas sensor (11) when one, two, and three pieces of fish of different weight are cooked by the grill heating. Symbol 1-1 represents the output characteristics when, for example, one piece of the fish is cooked by grill heating, 1-2 for 2 pieces and 1-3 for 3 pieces of the fishes, where the heating load corresponds to the dimensions of small, medium and large fish, respectively.

The micro-computer (20) first calculates the time needed to achieve the micro-wave heating finish level V3, and identifies said level V3 in relation to the time factors TIS, TIM and TIL before the micro-computer (20) eventually selects the time factors TMS, TMM, and TML previously stored in ROM of the micro-computer (20), and the bi-directional motor (14) is then activated to lower the position of the heater (4).

Said time factors TIS, TIM, and TIL correspond to the weight of the foodstuffs being cooked, where the time TIS corresponds to TMS, TIM corresponds to TMM, and TIL corresponds to TML, respectively.

It is thus clear from the above that the greater the load, i.e., weight of the foodstuff (24), the longer the time TML needed to feed the AC current to the bi-directional motor (14), and the longer the distance when lowering the heater (4), and as a result, the grill oven range can correctly perform the grill heating at the position nearest to the foodstuff (24).

When heating the foodstuff (24) with low weight, for example, when only one piece of said foodstuff (24) is heated and the time needed to feed the AC current to the (heater-lowering) motor (14) is identified as the timer factor TMS, then the distance will be shortened in lowering the heater (4), and as a result, an optimum distance between the foodstuff (24) and heater (4) can properly be set, thus resulting in the optimum grill heating condition.

The grill heating time with said heater (4) is assumed by the specific time duration TH.

Based on the principles described above, a grill heating is performed by the control means by fixing the activation time for the heater (4) so that the distance between the foodstuff (24) and heater (4) will be optimum in responding to the time when the microwave heating is being performed.

If the foodstuff (24) and the heater (4) either approach too close to each other or come into contact with each other when the height position of the heater (4) is lowered by the clockwise rotation of the bi-directional motor (14), the amount of the gaseous fumes, such as smoke, arising from the foodstuff (24) will rapidly increase. Consequently the level of the output voltage from the gas sensor (11) will be lowered below a preset output voltage VP (where VP VS), and the height position of the heater (4) must be set apart from the foodstuff (24).

To achieve this, the micro-computer (20) then instructs the relay (R3) of the bi-directional motor (14) to turn OFF by a signal sent to transistor (TR3) which then stops the clockwise rotation of said motor (14) through interface (19). Simultaneously, a signal is sent to transistor (TR4), which then activates relay (R4) so that said motor (14) will rotate counterclockwise.

When the bi-directional motor (14) rotates counterclockwise, since the heater (4) leaves the surface of the foodstuff (24), the amount of gaseous fume such as smoke rising from the foodstuff (24) will decrease. The bi-directional motor (14) stops the counterclockwise rotation exactly at the time TR when the gas sensor output voltage returns to the pre-determined output voltage level VP, eventually enabling the heater (4) to perform the heating up to the predetermined time TH so that the cooking will be completed.

Thus, when the height position of the heater (4) lowers, the grill oven of this invention first detects any abnormal condition while heating any foodstuff by electronically detecting the voltage level of the output from the gas sensor (11), then instantly corrects the height position of the heater (4) so that any excessive heating operation can quickly and effectively be prevented.

Conventionally, in order to avoid any adverse effect from the micro-waves, external surfaces of heaters performing the grill heating are provided with iron-pipes. Thus it was quite necessary to provide a significantly large thermal-time constant. For example, most heaters usually need about 1 to 2 minutes before they are fully glowing. As a result, when the mode is changed to the grill heating from the micro-wave heating, and if any abnormal condition arises from the heater being in direct contact with the foodstuff, since the surface of the grill heater still does not contain enough heat to perform the intended heating, little gaseous fumes or smoke will be generated upon contact with the foodstuff in the chamber.

When changing the mode from the micro-wave heating to the grill heating, it is preferred to provide an effective control means which enables the heater to be lowered to a proper position and remain in the intended height with respect to the foodstuff after the heater has been set at a specific height position.

It should expressly be understood that this invention is not limited to the examples disclosed and described. This invention relates to automatically controlling the grill heating and height position of the heater as well as automatically identifying the programed menu through the signal level of the output from the gas sensor and relates to foods other than "salted mackerel" and "gratin" referred to the description.

The scope of this invention also comprises such mechanisms as can properly control the grill heating and height position of the heater in responding to the input signals.

As expressly described, this invention provides a variety of advantages for the grill oven in automatically adjusting the height position of the heater in accordance with the electronically identified menu contents so that the grill oven range embodied by this invention automatically eliminates user's labour otherwise needed to perform an adjustment of the correct height position of the heater before performing the grill heating.

What is claimed is:

1. An oven comprising:
a chamber;
support means for supporting a foodstuff within said chamber;
first means for heating the foodstuff by high frequency electromagnetic waves;
second means within said chamber for heating the foodstuff by application of thermal energy to the foodstuff, said second means being movably supported whereby it is translatable toward and away from a foodstuff on said support means;
sensor means for sensing a condition of the foodstuff during heating thereof; and
means responsive to said sensor means for identifying the foodstuff.

2. An oven as in claim 1, wherein said sensor means is adapted to sense a condition of the foodstuff at plural times during heating thereof; and
said means responsive to said sensor means is responsive to variation in sensor output at respective times for identifying the foodstuff.

3. An oven as in claim 1 further comprising means responsive to said sensor means for controlling the position of said second means within said chamber.

4. An oven as in claim 1, wherein said means for identifying the foodstuff comprises means for controlling the position of said second means within said chamber.

5. An oven as in claim 1, further comprising means responsive to said sensor means for controlling the period of time during which said second means is operative to heat the foodstuff.

6. An oven as in claim 1, wherein said means for identifying the foodstuff comprises means for controlling the period of time during which said second means is operative to heat the foodstuff.

7. An oven comprising:

a chamber;

support means for supporting a foodstuff within said chamber;

first means for heating the foodstuff by high frequency electromagnetic waves;

second means within said chamber for heating the foodstuff by application of thermal energy to the foodstuff, said second means being movably supported whereby it is translatable toward and away from a foodstuff on said support means;

sensor means for sensing a condition of the foodstuff during heating thereof; and means responsive to said sensor means for identifying the foodstuff and for controlling the position of said second means within said chamber.

8. An oven as in claim 7, wherein said sensor means is adapted to sense a condition of the foodstuff at plural times during heating thereof; and said means responsive to said sensor means is responsive to variation in sensor output at respective times for controlling the position of said second means within said chamber.

9. An oven as in claim 7, further comprising means for controlling the period of time during which said second means is operative to heat the foodstuff.

10. An oven as in claim 7, wherein said means for controlling the position of said second means comprises means for controlling the period of time during which said second means is operative to heat the foodstuff.

11. An oven as in claim 1, wherein said sensor means comprises means for detecting gaseous substances emitted by the foodstuff during heating.

12. An oven as in claim 7 wherein said sensor means comprises means for detecting gaseous substances emitted by the foodstuff during heating.

* * * * *